US010006218B2

(12) United States Patent
Marinoni

(10) Patent No.: US 10,006,218 B2
(45) Date of Patent: Jun. 26, 2018

(54) PREFABRICATED WHITE CHAMBER STRUCTURE

(71) Applicant: SINTECO IMPIANTI S.R.L., Sesto San Giovanni (IT)

(72) Inventor: Attilio Marinoni, Sesto San Giovanni (IT)

(73) Assignee: SINTECO IMPIANTI S.R.L., Sesto San Giovanni (MI) (IT)

( * ) Notice: Subject to any disclaimer, the term of this patent is extended or adjusted under 35 U.S.C. 154(b) by 0 days. days.

(21) Appl. No.: 15/223,899

(22) Filed: Jul. 29, 2016

(65) Prior Publication Data

US 2017/0030097 A1 Feb. 2, 2017

(30) Foreign Application Priority Data

Jul. 30, 2015 (IT) ..... 102015000040455

(51) Int. Cl.
*E04H 5/02* (2006.01)
*E04H 3/08* (2006.01)
*F24F 3/16* (2006.01)

(52) U.S. Cl.
CPC ..... *E04H 5/02* (2013.01); *E04H 3/08* (2013.01); *F24F 3/161* (2013.01)

(58) Field of Classification Search
CPC ..... F24F 3/161; F24F 2221/36; E04H 3/08; E04H 5/02; E04H 3/00; E04H 14/00
See application file for complete search history.

(56) References Cited

U.S. PATENT DOCUMENTS 3,638,404 A 2/1972 Moll
4,409,889 A * 10/1983 Burleson ..... F24F 3/161 454/187
5,195,922 A * 3/1993 Genco ..... F24F 3/161 454/187
5,256,105 A 10/1993 Austin
5,259,812 A * 11/1993 Kleinsek ..... F24F 3/161 312/1
5,979,684 A * 11/1999 Ohnishi ..... B62D 29/045 220/1.5
7,083,515 B2 * 8/2006 Rapisarda ..... E04B 1/98 454/187
7,288,192 B2 * 10/2007 Jowett ..... C02F 3/04 210/150
7,326,355 B2 * 2/2008 Graetz ..... A61M 1/0236 141/10
7,707,931 B2 * 5/2010 Garrett ..... A22C 18/00 422/292

(Continued)

FOREIGN PATENT DOCUMENTS

GB 2177501 A 1/1987

OTHER PUBLICATIONS

Italian Patent Office Search Report and Written Opinion dated Feb. 8, 2016 (partially in English).

(Continued)

*Primary Examiner* — Andrew J Triggs
(74) *Attorney, Agent, or Firm* — Hedman & Costigan, P.C.; James V. Costigan; Kathleen A. Costigan

(57) ABSTRACT

A prefabricated white chamber structure is adapted to be periodically sanified and washed and comprises one or more shop pre-assembled modules, including all the necessary utility assemblies and adapted to be re-assembled at a use site.

6 Claims, 7 Drawing Sheets

(56) References Cited

U.S. PATENT DOCUMENTS

| | | | | |
|---|---|---|---|---|
| 8,523,644 | B2 * | 9/2013 | Melles | A61G 13/108 454/187 |
| 8,621,786 | B2 * | 1/2014 | Lam | E04H 5/02 52/174 |
| 8,656,670 | B2 * | 2/2014 | Mouzannar | E04H 3/08 454/187 |
| 2007/0039260 | A1 * | 2/2007 | Haddad | E04H 1/1216 52/241 |
| 2010/0251677 | A1 | 10/2010 | Franck | |
| 2012/0077429 | A1 * | 3/2012 | Wernimont | F24F 3/161 454/187 |
| 2015/0101264 | A1 * | 4/2015 | Jornitz | E04H 3/08 52/79.9 |
| 2017/0030097 | A1 * | 2/2017 | Marinoni | E04H 1/005 |

OTHER PUBLICATIONS

GMP Technical Solutions, GMP Cleanrooms, HVAC System, pharmaceutical-tec.com, Apr. 7, 2015.

* cited by examiner

PREFABRICATED WHITE CHAMBER STRUCTURE

BACKGROUND OF THE INVENTION

The present invention relates to a prefabricated white chamber structure.

The white chamber structure according to the present invention has been specifically designed for the food industry and the electronic, pharmaceutical, hospital, medical, optical fields.

As is known, a lot of enforcing Rules, mainly with respect to food safety, compel makers to preserve a desired quality of the food product by controlling the environmental air quality and properly managing the temperature and relative humidity or moisture levels, as well as the pressure difference in the rooms in which the food processing operations are performed.

As is further known, a "white chamber" is a temperature, moisture, and particle concentration controlled room.

The air purity in the herein disclosed white chambers is classified by the ISO 14644 and subsequent standards, depending on a maximum number of particles having a diameter of 0.5 microns contained in a cubic meter of air.

The above standard defines the following environmental classes:

| | | |
|---|---|---|
| ISO 3 class | max contents of 35 | particles/$m^3$ |
| ISO 4 class | max contents of 352 | particles/$m^3$ |
| ISO 5 class | max contents of 3,520 | particles/$m^3$ |
| ISO 6 class | max contents of 35,200 | particles/$m^3$ |
| ISO 7 class | max contents of 352,000 | particles/$m^3$ |
| ISO 8 class | max contents of 3,520,000 | particles/$m^3$ |
| ISO 9 class | max contents of 35,200,000 | particles/$m^3$ |

The ISO 3 class provides the highest air purity level.

The class is normally detected in a rest condition, that is in a finished work environment, in a ready to use condition with the production machines installed and switched on, but without operators and products in the working environment.

The requirements of a white chamber are as follows:

- A filtering of air to be introduced into the working environment by a progressive system of increasingly efficient filtering barriers, up to a use of HEPA/ULPA absolute filters, with a minimum picking up efficiency of H13 99.95%-H14 99.995% (DOS test).
- An overpressure of the working environment or room compared to adjacent processing rooms, in order to allow the air flow to be always oriented from the cleanest environment to the progressively less clean environment.
- An environment air flow-rate, that is the air/hour volumes required to dilute polluting powders and hold a desired class. The cleaner should be the environment, the higher will be said volumes/hour.
- The air flow within the processing room is of a conventional/turbulent type (to meet the ISO 7÷ ISO 8 classes). The flow being of a laminar type to meet the ISO 5 class.
- Room cleaning: consists of designing the white chamber both to provide easily washable surfaces, without zones holding dirt, and studying the personnel and product movement paths to prevent the classed zones from being polluted.

The objective of the white chamber for the food processing industry, and in a specific case of cutting and/or packaging and producing rooms, is to protect the air exposed food product from any risk of pollution, while minimizing its contamination, and holding constant and improving the end quality of the product while extending its shelf life.

In order to achieve a proper protection, without affecting the overall volume of the room, it would be possible to provide, in that zone in which the product is maximally exposed to pollution, a closest protection, the so-called "clean zone", by providing a laminar flow designed to affect by air the product up to the packaging of the latter; in this manner, on the product it would be possible to achieve a cleaning class even better than the ISO 5 class.

The structures and civil works necessary to assure the required cleaning, hygienic, safety and quality properties, currently requested by the market, both in an industrial environment, for example in making or feeding meats, cuttings, packagings and in the commercial field, of cutting, packaging, and selling products on the processing site with variously fed products, are currently made with long operation times and high making costs.

Another drawback of prior structures is that the available spaces are not always sufficiently large and properly arranged.

SUMMARY OF THE INVENTION

The aim of the present invention is to provide such a prefabricated white chamber structure adapted to be simply and quickly installed at the user's site without the need of performing civil works, with an optimized lay-out with respect to the installing site.

Within the scope of the above mentioned aim, a main object of the invention is to provide such a white chamber structure allowing to improve the environmental conditions and preserve the ideal thermo-hygrometric conditions for properly performing the making processes.

Another object of the present invention is to provide such a white chamber structure allowing to optimize the system sanification conditions.

Yet another object of the present invention is to provide such a white chamber structure allowing to improve the air quality at critical processing points susceptible to be subjected to a risk of pollution.

Yet another object of the present invention is to provide such a white chamber structure which, owing to its specifically designed constructional features, is very reliable and safe in operation.

According to one aspect of the present invention, the above mentioned aim and objects, as well as yet other objects, which will become more apparent hereinafter, are achieved by a prefabricated white chamber structure, characterized in that said prefabricated white chamber structure comprises one or more shop pre-assembled modules, including all the necessary utility assemblies and adapted to be re-assembled at a use site.

Each said module of said structure comprises a prefabricated floor or flooring, perimetrical walls and inner separating walls, doors and windows, an air delivery plenum chamber of a laminar flow type and with a plurality of recovering channels, an air processing unit built-in in the structure, and arranged on a top of the white chamber, in a fitting or auxiliary equipment space.

BRIEF DESCRIPTION OF THE DRAWINGS

Further characteristics and advantages of the present invention will become more apparent hereinafter from the following detailed description of a preferred, though not exclusive, embodiment of the invention which is illustrated, by way of an indicative but not limitative example, in the accompanying drawings, where.

DESCRIPTION OF THE PREFERRED EMBODIMENTS

Figure 1:
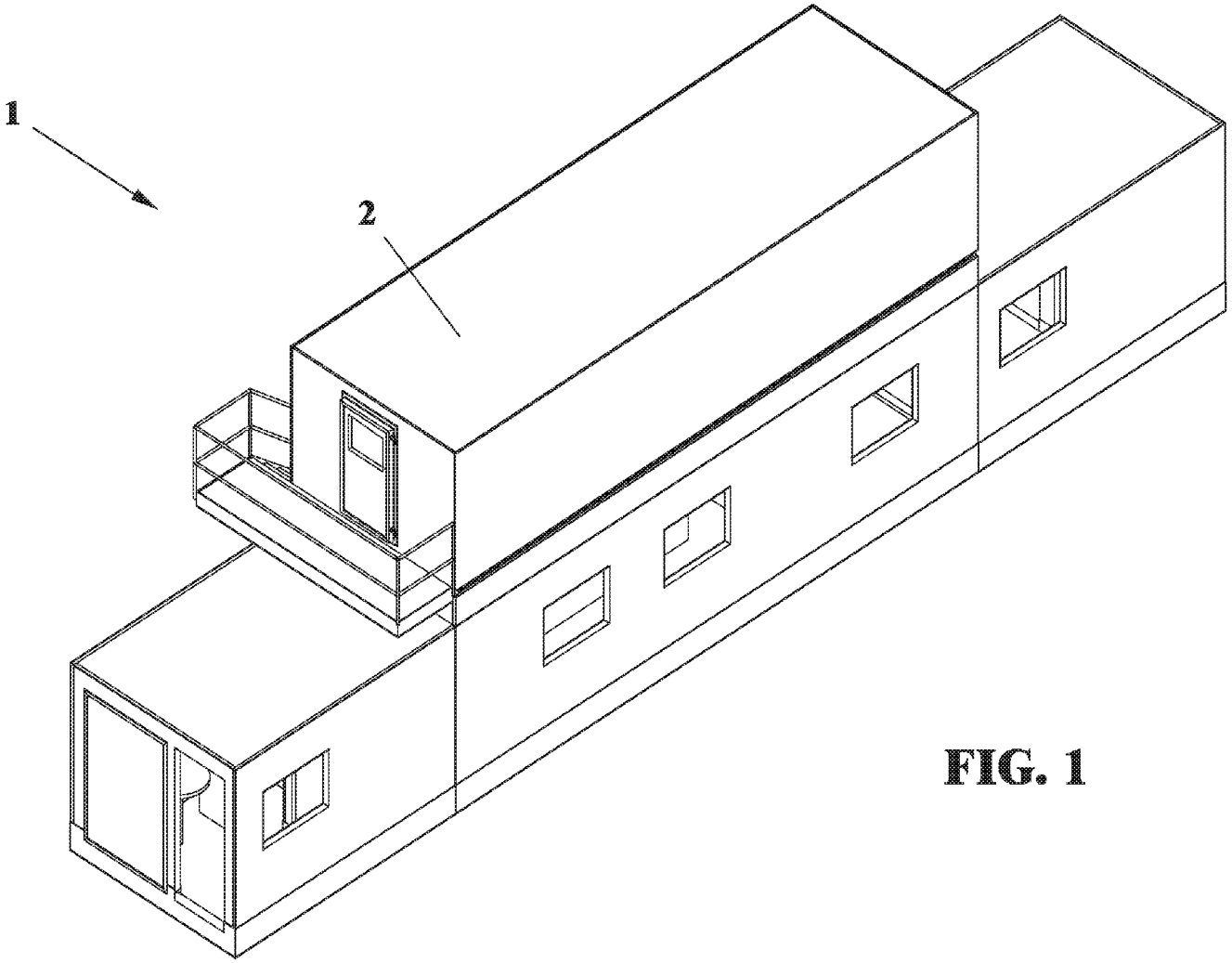
FIG. 1 is a schematic perspective view of an embodiment of the prefabricated white chamber structure, according to the present invention.
Figure 2:
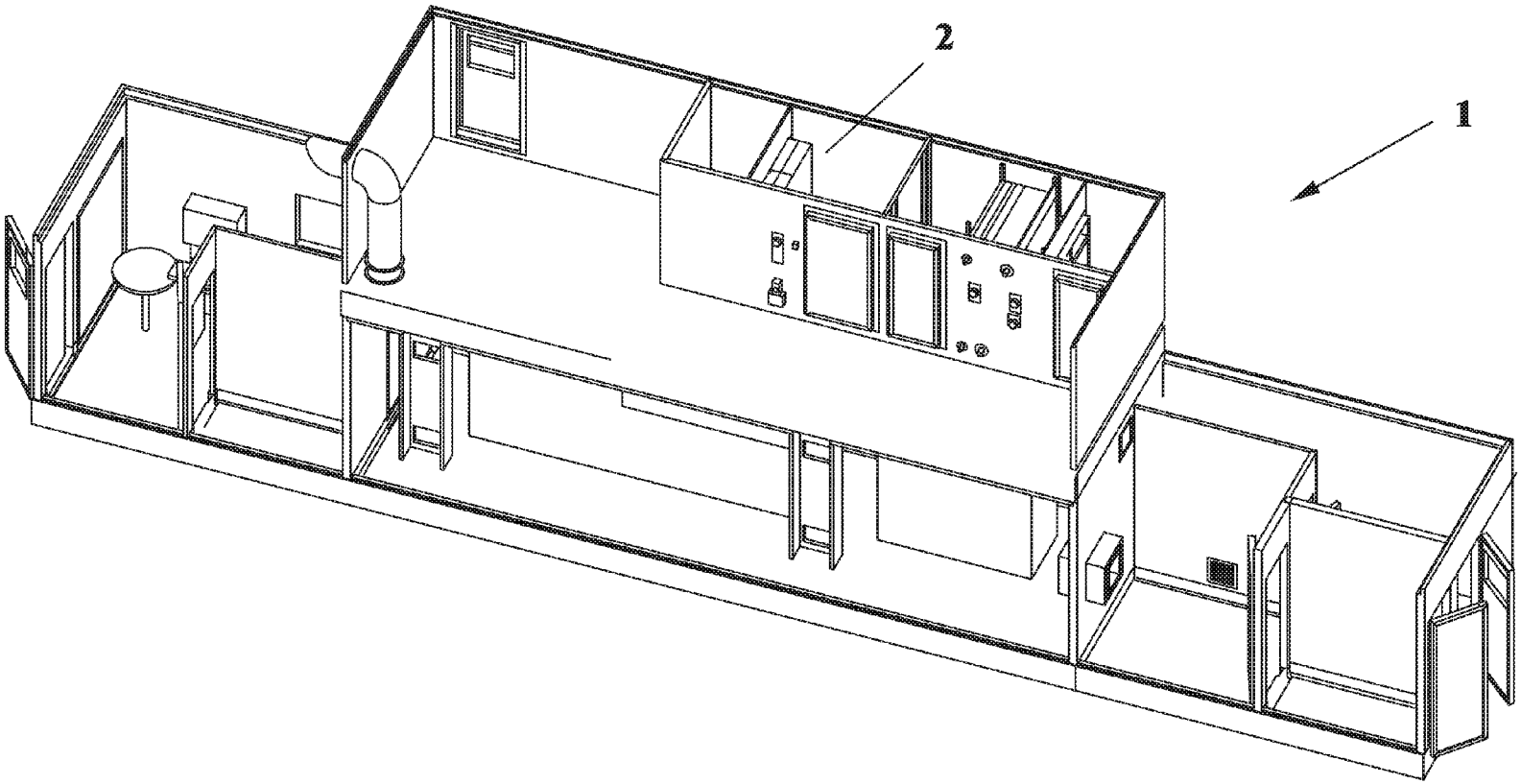
FIG. 2 is a perspective view, partially in a see-through condition, of the structure of FIG. 1.
Figure 3:
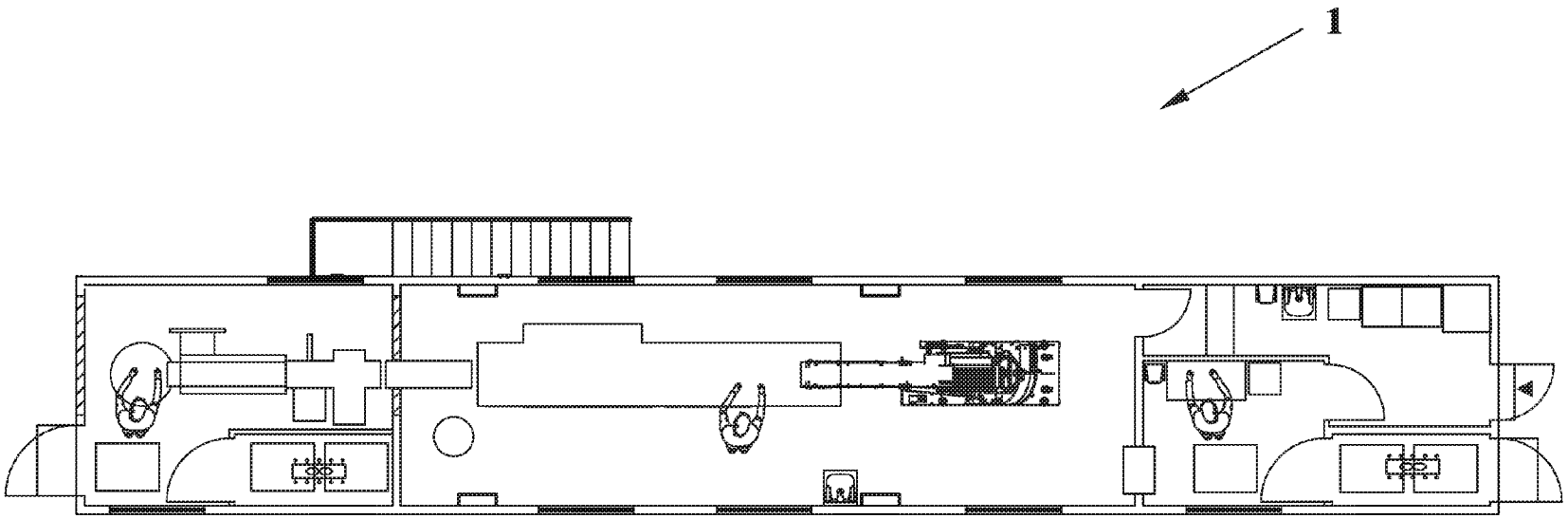
FIG. 3 is a top plan view of the structure shown in FIGS. 1 and 2.
Figure 5:
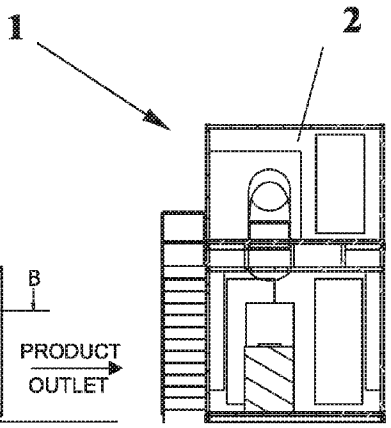
FIG. 5 is a front elevation view of the subject structure.
Figure 4:
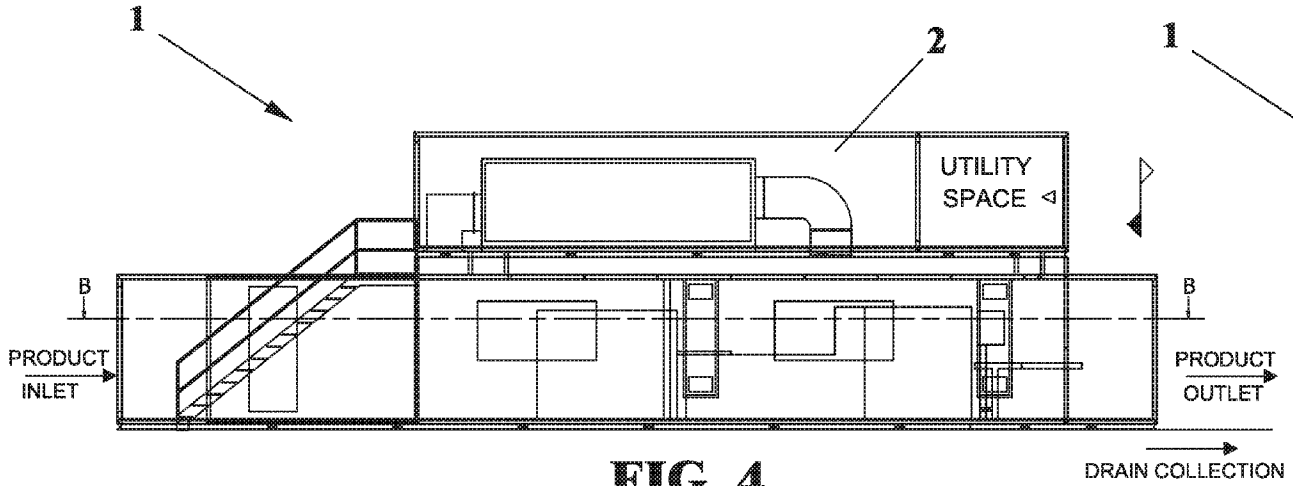
FIG. 4 is a side elevation view, partially in a see-through condition, of the subject structure.
Figure 6:
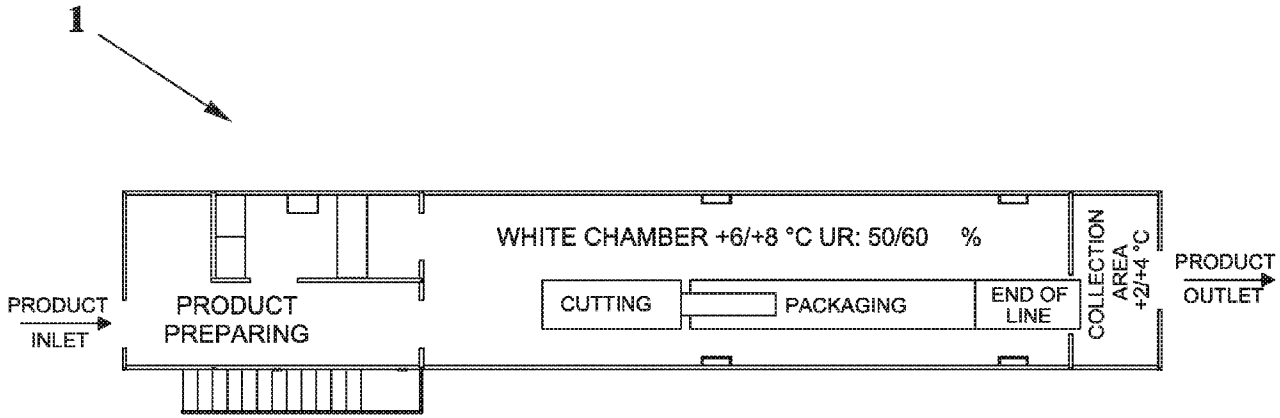
FIG. 6 is a top plan view of the structure shown in FIGS. 4 and 5.
Figure 7:
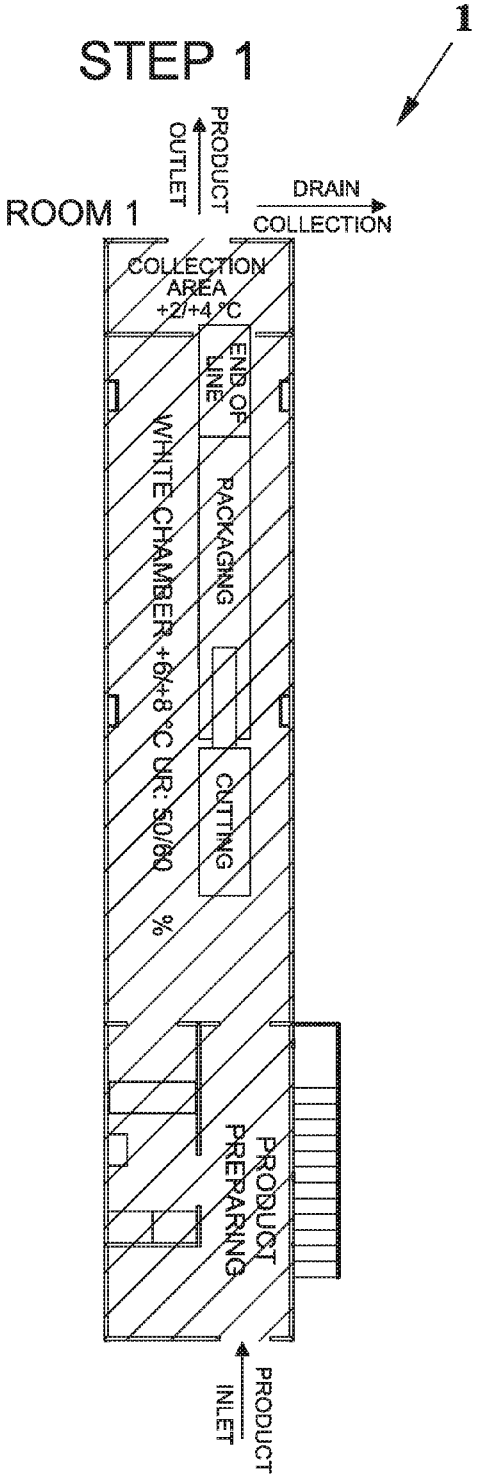
FIGS. 7-10 show an example of a possible operating sequence for broadening the white chamber structure.
Figure 8:
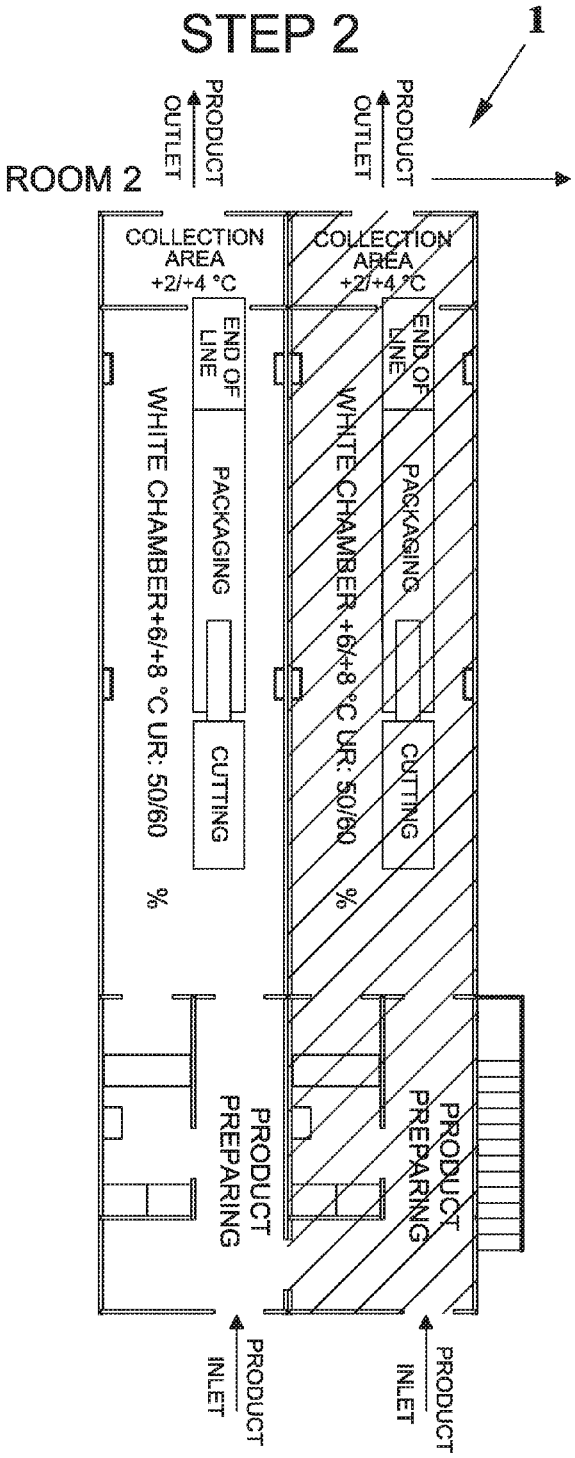
Figure 9:
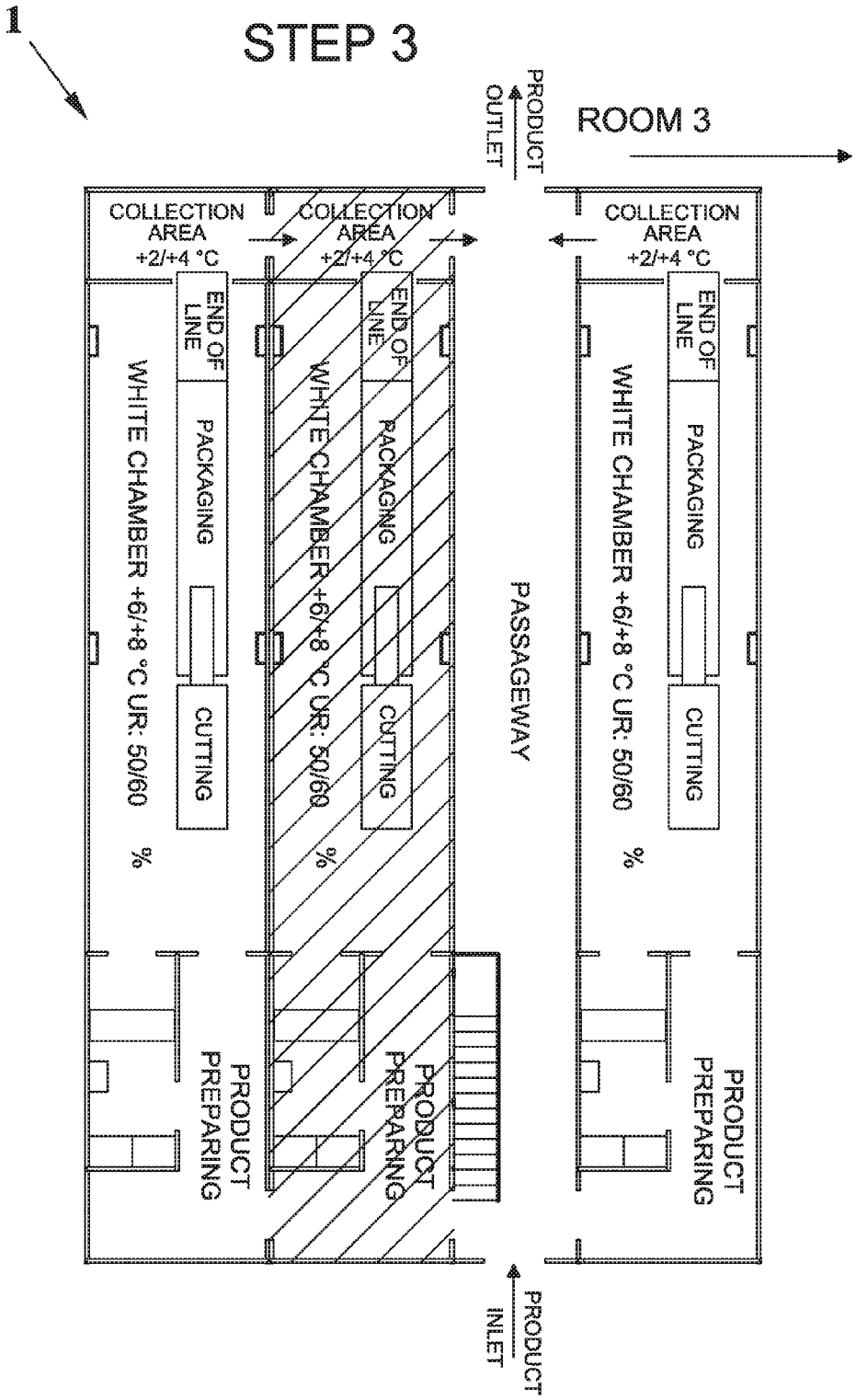
Figure 10:
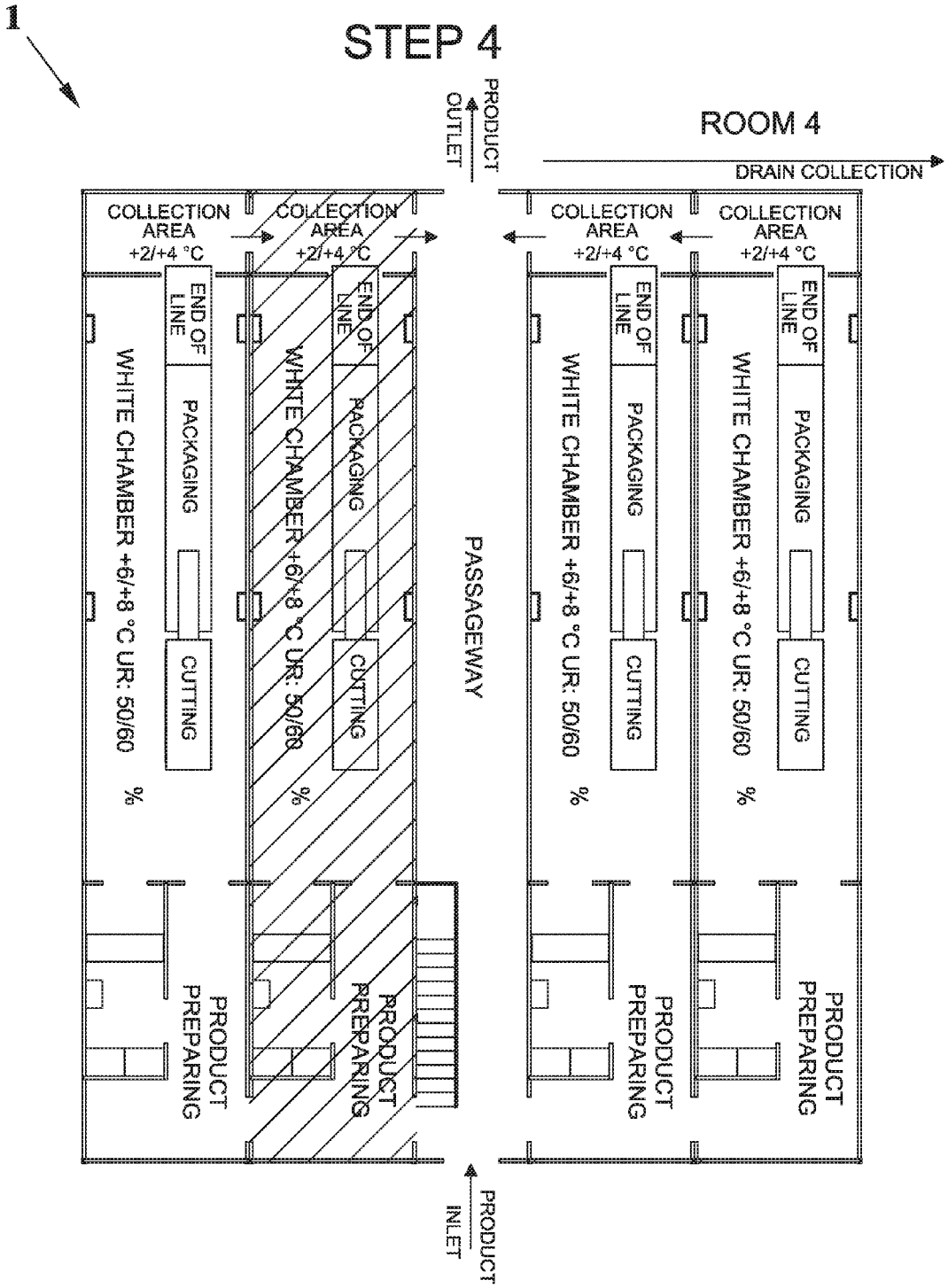

With reference to the number references of the above mentioned figures, the prefabricated white chamber structure according to the present invention, generally indicated by the reference number 1, comprises one or more shop pre-assembled modules, including all the necessary utility assemblies and adapted to be re-assembled at a user site.

Each said module comprises a prefabricated floor or flooring (PIF), perimetrical walls and inner separating walls, doors and windows, an air delivery plenum chamber of a laminar flow type or Aertex fabric channel and a plurality of recovering channels, and an air processing unit being arranged on a top of the white chamber, in a fitting or auxiliary equipment space.

Said pre-insulated floor (PIF) is made in a making shop and may be easily transported to the installation site with a very short installing time.

Said floor is made of a single structural block which may have a comparatively large size.

More specifically, said pre-insulated floor is preferably made of a stainless steel sheet metal material of a AISI 304L type, being welded by a TIG welding method, and being fully reinforced by large size steel section members to provide a highly rigid construction, and being optionally resin coated or processed.

All the steel frames are sprayed by a plurality of polyurethane layers, to provide steam barriers, said polyurethane being a high density (40 kg/m$^3$) polyurethane material.

Preferably, an arrangement of three (or more) draining points provided with driving siphons and built-in in the flooring is provided.

The height of the structure about the supporting plane is of 400 mm.

The pre-insulated floor is arranged on a supporting flooring, preferably of a concrete material, perfectly leveled, with a maximum permitted tolerance of 5 mm.

The perimetrical panels, constituting the room inner dividing walls and ceiling, are constituted by sandwich single-block panels, of a great size without joining connections, and of a double-skin type with a thickness of about 40/60/100 mm and with a white glass-resin inner and outer finishing.

Each said panel having an inner part of a Styrofoam material, with a 40 kg/m$^3$ density.

Thereby the prefabricated white chamber structure is adapted to be periodically sanified and washed.

In the example herein shown, the white chamber comprises five single-wing doors of a plastic material with an inspection window, three single-wing doors of a plastic material without inspection windows, nine perimetrical windows and shells of a stainless steel material built-in in the structure floor. The number of doors and windows may be changed depending on the client's requirements.

The air processing unit of a 2-star type (constituting the subject-matter of another patent by the same Applicant), being indicated by the reference number 2, is made of a construction including a plurality of polyester panels, having rounded corner portions and being designed for allowing all the inner elements to be washed.

The panels pertaining to the air processing unit are made of a polyester material with an associated high thickness (60 mm) thermoacoustic insulating arrangement.

The inner components or fittings, such as fans, thermoigrometric processing batteries and filters are mounted and firmly fixed to a stainless steel frame.

The above strong stainless steel frame being anchored on a strong galvanized steel framework, outside of the air processing unit, and being raised from the floor plane, and providing the overall processing unit with a desired high strength.

Said unit comprises moreover resin processed surfaces for providing the machines with the standard requirements necessary for providing a sealed connection and for insulating the air processing unit, with suitable planar surfaces and properly slanted drains, and with no thermal bridges at all.

The air processing unit comprises moreover large size air processing unit doors, at each section, for servicing and inspecting the filters and movable parts; all the inner components being adapted to be disassembled through the unit doors. Said doors comprise a plurality of fixed gaskets of a closed cell type with related progressive clamping closing handles.

The fan chamber access door comprises a micro-protecting assembly for switching the fans to an off condition.

The air processing unit fittings comprise moreover differentiated visual pointer pressure gauges (Dwyer), a safety microswitch for inspection doors, and flow rate calibrating and throttling gates of a stainless steel material.

The several units being moreover provided with suitable perforations, wells and passages necessary for a proper location of all the probes, drives and electric cables.

The condensation and washing drains in each air processing unit section are made with an outlet mouth portion of a stainless steel material.

The electric system on board of the machine is so made that it does not require any additional operation on the machine by electricians and/or mechanics.

The air processing unit comprises moreover an environment air intake gate of a stainless steel material, an outside air intake gate of a stainless steel material and an air pre-filtering section.

Said pre-filtering section comprises a synthetic G4 recoverable folded cell pre-filter, of a 48 mm thickness, being arranged on an arranging plane, with a gravimetric 90% ASHRAE 52-76 efficiency.

The air processing unit comprises moreover a filtering section comprising a plurality of rigid pocket F7 filters and a cooling battery section.

Said cooling battery section is a finned pack Cu/Al or stainless steel/Al cooling battery with a fin pitch to be defined depending on the requirements, and with a cold water and ethylene glycol or propylene glycol feeding arrangement (30%) at −6° C./−2° C.

The air processing unit comprises moreover a finned pack Cu/Al heating battery section with a fin pitch to be defined depending on the requirements and with a hot water feeding arrangement at a minimum temperature of +40° C./+30° C.

Said air processing unit comprises moreover a delivery air fan section including a direct transmission centrifugal fan of a "plug-fan" type, made of a painted steel material, with a related electric motor.

Said air processing unit comprises moreover a delivery absolute filtering section with H13 absolute filters.

In order to achieve relative moisture low values and a reduced time for drying the chamber at the end of the washing of said chamber, the machine may also comprise an inner chemical dehumidifying wheel assembly.

The air rate on the disclosed batteries has been evaluated as lower than 2.9 m/s.

By way of an example, the technical characteristics of a 10,000 mc/h air processing unit, are as follows:

delivery air flow rate: $m^3$/h 10,000
installed electric power: kW 5.5
refrigerating capability: kW 35 (Frig/h 30,000)
thermal performance: kW 30/Kcal/h 25,000)

The air processing unit comprises moreover a temperature and moisture adjusting assembly including a temperature and moisture probe, with a temperature and moisture electronic adjusting device and related adjusting and limit temperature probes.

The control assemblies are pre-mounted and pre-connected near the air processing unit.

The air processing unit comprises moreover air delivery and recovery ducts, with a delivery laminar flow including a plurality of H14 filters arranged in a four assembly panel recovery environment, including a plurality of stainless steel air recovery grids.

The white chamber structure comprises an electric panel for controlling and managing the overall system, being installed at a technical zone beside the air processing unit.

The controlling and adjusting apparatus comprises a painted steel framework being adapted to hold the driving and protecting apparatus for the single user units, and being made with a desired protection degree.

In the main control board are installed the following components:

- a main automatic switch assembly;
- an aerating and air filtering assembly also in said main control panel or board;
- a servicing assembly;
- a 400/24 Vac transformer assembly;
- a stabilized 230-124 Vdc power supply unit;
- an inverter
- light selectors having three stable positions for selecting the mode of operation, either automatic or manual, of the air processing unit.

The white chamber comprises moreover a remote control device for managing the production, washing, drying and servicing operation steps.

The electronic programmable managing and control system comprises the following components:

- a central control unit (PLC);
- input and output digital cards, for controlling the user assembly operating conditions and for providing an automatic start;
- analogic input and output cards for measuring process variables and controlling modulating adjusting assemblies.

In said control or drive board or panel is moreover installed an operator panel (of a touch screen type) where it is possible to set and display the process variables (such as temperature, environmental moisture, fluid modulating valve opening rates, servo-controls, gates and alarms).

The control software is supplied by the Applicant (SINTECO IMPIANTI S.r.I.) and is programmed according to the user's production contingent requirements.

Is herein provided a standard adjusting assembly (for adjusting hot/cold conditions) serving the air processing unit and comprising a cooling assembly and a post-heating assembly.

The assembling, starting and testing of the white chamber structure are performed by the Applicant (SINTECO IMPIANTI S.r.I.), who provides assembling or mounting operators for properly locating the whole prefabricated white chamber.

At the end of the system assembling and after having performed the proper hydraulic and electric connections, a skilled operator from the Applicant (SINTECO IMPIANTI S.r.I.) will be available for starting and testing the overall system.

The prefabricated white chamber structure according to the present invention comprises a series of fittings including, by way of an example, the following:

- a refrigerating assembly,
- a product tray receiving table,
- a cutting machine,
- a packaging machine,
- a weight selecting machine,
- a personnel vertical cabinet,
- a personnel bench,
- disposable material,
- a spare coil cabinet,
- a pedal basin,
- a knife sterilizer,
- a metal detector,
- a refrigerating cell at −10° C.
- a stainless steel bench for packaging the food product,
- a refrigerating cell at +2° C.,
- recessed LED lights and related electric system.

It has been found that the invention fully achieves the intended aim and objects.

In fact, the invention has provided a prefabricated modular white chamber structure allowing to meet the requirements of specific users, desiring to exploit at a maximum degree the available spaces, by a novel system providing a ready to use pre-assembled processing pole, and further including a qualified after-sales and planned maintenance service.

The present invention provides a prefabricated white chamber, of a monolithic and easily transportable type, allowing to meet, in a very short time, all the requirements related to cleaning, hygienic, safety and quality characteristics required by the market, for example for processing and feeding meats, cuttings, packagings, both in a commercial market, for cutting, packaging, selling at a given place of processing, with several types of products.

In practicing the invention, the materials used, as well as the contingent size and shapes, can be any, depending on requirements.

The invention claimed is:

1. A prefabricated monolithic white chamber structure, for food, electronic, pharmaceutic, hospital, medical or optical industry, comprising one or more shop pre-assembled modules, including utility assemblies and adapted to be re-assembled at a use site, each said module comprising a prefabricated pre-insulated floor, perimetrical walls and inner separating walls, doors and windows, an air delivery plenum chamber of a laminar flow type and with a plurality of recovering channels, and an air processing unit arranged on a top of the white chamber, in a fitting or auxiliary equipment space, said prefabricated pre-insulated floor being made of a stainless steel sheet metal material, reinforced by steel section members that are resin coated, said structure comprising a plurality of steel frames, all of said steel frames being sprayed with a plurality of polyurethane layers forming steam barriers, said walls comprising a plurality of perimetrical panels forming inner dividing walls and a ceiling of said white chamber; said perimetrical panels being of a double-skin or coating sandwich type with a white glass-resin inner and outer finishing; each said perimetrical panel having an inner part of a polystyrene material, thereby the white chamber structure is adapted to be periodically sanified and washed, said structure comprising a plurality of single-wing doors of a plastic material with an inspection window, single-wing doors of a plastic material without inspection window, and perimetrical windows, said air processing unit comprising an air processing construction including a plurality of polyester panels having rounded corner portions and being designed for allowing all inner fittings to be washed; said polyester panels having a thermoacoustic insulating arrangement; the inner fittings, such as fans, thermoigrometric processing batteries and filters being mounted and firmly fixed to a stainless steel frame; said stainless steel frame being anchored to a galvanized steel framework, outside of the air processing unit, and being raised from a floor plane; said unit comprising resin processed surfaces for providing a sealed connection and for insulating the air processing unit; said air processing unit comprising air processing unit doors, at each section, for servicing and inspecting the filters and movable parts; said doors comprising fixed gaskets of a closed cell type with related progressive clamping closing handles; a fan chamber access door including a micro-protecting assembly for switching the fans to an off condition.

2. A structure, according to claim 1, wherein said structure comprises a system controlling and adjusting apparatus mounted at a technical region near the air processing unit; said controlling and adjusting apparatus comprising a steel framework for supporting a single user unit driving and protecting apparatus.

3. A structure, according to claim 1, further comprising a remote selector device for managing production, washing, drying and servicing operation steps and a programmable managing and control electronic system comprising a central control unit (PLC).

4. A structure, according to claim 1, wherein said structure comprises a standard temperature adjusting assembly serving the air processing unit and comprising a cooling assembly and a post-heating assembly.

5. A prefabricated monolithic white chamber structure, for the food, electronic, pharmaceutic, hospital, medical or optical industry, comprising one or more shop pre-assembled modules, including utility assemblies and adapted to be re-assembled at a use site, each said shop pre-assembled modules comprising a prefabricated pre-insulated floor, perimetrical walls and inner separating walls, doors and windows, an air delivery plenum chamber of a laminar flow type and with a plurality of recovering channels, and an air processing unit arranged on a top of said white chamber structure, in a fitting or auxiliary equipment space, said prefabricated pre-insulated floor being made of a stainless steel sheet metal material, reinforced by steel section members that are resin coated, said structure comprising a plurality of steel frames, all said steel frames being sprayed with a plurality of polyurethane layers forming steam barriers, said walls comprising a plurality of perimetrical panels forming inner dividing walls and a ceiling of said white chamber; said perimetrical panels being of a double-skin or coating sandwich type with a white glass-resin inner and outer finishing; each said perimetrical panel having an inner part of a polystyrene material, thereby the white chamber structure is adapted to be periodically sanified and washed, wherein said air processing unit comprises an air processing construction including a plurality of polyester panels having rounded corner portions and being designed for allowing all inner fittings to be washed; said polyester panels having a thermoacoustic insulating arrangement; the inner fittings, such as fans, thermoigrometric processing batteries and filters being mounted and firmly fixed to a stainless steel frame; said stainless steel frame being anchored to a galvanized steel framework, outside of the air processing unit, and being raised from a floor plane; said unit comprising resin processed surfaces for providing a sealed connection and for insulating the air processing unit; said air processing unit comprising air processing unit doors, at each section, for servicing and inspecting the filters and movable parts; said doors comprising fixed gaskets of a closed cell type with related progressive clamping closing handles; a fan chamber access door including a micro-protecting assembly for switching the fans to an off condition.

6. A prefabricated monolithic white chamber structure, for food, electronic, pharmaceutic, hospital, medical or optical industry, comprising one or more shop pre-assembled modules, including utility assemblies and adapted to be re-assembled at a use site, each said module comprising a prefabricated pre-insulated floor, perimetrical walls and inner separating walls, doors and windows, an air delivery plenum chamber of a laminar flow type and with a plurality of recovering channels, and an air processing unit arranged on a top of the white chamber, in a fitting or auxiliary equipment space, said prefabricated pre-insulated floor being made of a stainless steel sheet metal material, reinforced by steel section members that are resin coated, said structure comprising a plurality of steel frames, all said steel frames being sprayed with a plurality of polyurethane layers forming steam barriers, said walls comprising a plurality of perimetrical panels forming inner dividing walls and a ceiling of said white chamber; said perimetrical panels being of a double-skin or coating sandwich type with a white glass-resin inner and outer finishing; each said perimetrical panel having an inner part of a polystyrene material, thereby the white chamber structure is adapted to be periodically sanified and washed, wherein said air processing unit comprises an environment air intake gate of a stainless steel material; an outside air intake gate of a stainless steel material, and an air pre-filtering section; a pre-filtering section comprising a synthetic G4 recoverable folded cell pre-filter; a filtering section comprising a plurality of rigid pocket F7 filters, and a cooling battery section; a stainless steel/aluminum or copper/aluminum finned pack cooling battery; a copper/aluminum finned pack heating battery section; a delivery air fan section including a direct transmission centrifugal fan; a delivery absolute filtering section with H13 absolute filters; a chemical dehumidifying wheel assembly, a temperature and moisture adjusting assembly including a temperature and moisture probe, with a channel-like mounting, an electronic adjuster device for adjusting temperature and moisture and a temperature probe between the batteries; air delivery and recovery ducts with a delivery laminar flow including a plurality of H14 filters arranged in a four assembly panel recovery environment, including a plurality of stainless steel air recovery grids.

* * * * *